US006705194B2

(12) United States Patent
Geskin et al.

(10) Patent No.: US 6,705,194 B2
(45) Date of Patent: Mar. 16, 2004

(54) SELFRECHARGEABLE GUN AND FIRING PROCEDURE

(75) Inventors: Ernest S. Geskin, Edison, NJ (US); Boris Goldenberg, Brooklyn, NY (US)

(73) Assignee: Jet Energy, Inc., NJ (US)

( * ) Notice: Subject to any disclaimer, the term of this patent is extended or adjusted under 35 U.S.C. 154(b) by 0 days.

(21) Appl. No.: 09/960,506

(22) Filed: Sep. 24, 2001

(65) Prior Publication Data

US 2002/0121186 A1 Sep. 5, 2002

Related U.S. Application Data

(60) Provisional application No. 60/233,869, filed on Sep. 20, 2000.

(51) Int. Cl.[7] ..... F41F 5/00
(52) U.S. Cl. ..... 89/1.1; 62/60
(58) Field of Search ..... 89/1.1; 62/60, 62/66, 356

(56) References Cited

U.S. PATENT DOCUMENTS 3,866,838 A * 2/1975 Miles
3,886,972 A * 6/1975 Scott et al.
3,906,972 A * 9/1975 Jensen et al.
3,921,980 A * 11/1975 Artzer
4,389,820 A * 6/1983 Fong et al.
4,833,961 A * 5/1989 Adini
5,083,707 A * 1/1992 Holden
5,125,819 A * 6/1992 Hager et al.
5,461,874 A * 10/1995 Thompson
6,141,985 A * 11/2000 Cluzeau et al.

OTHER PUBLICATIONS

Application of Ice Particles for Precision Cleaning of Sensitive Surfaces, Jul. 1999, Geskin.*
NJIT web page: http//www.njit.edu/old/ME/Centers/watrjet1.html, Sep. 25, 2000.*

* cited by examiner

*Primary Examiner*—Michael J. Carone
*Assistant Examiner*—Troy Chambers

(57) ABSTRACT

A method for formation of slugs in a gun barrel and acceleration of these slugs up to the speed of 3 km/sec and more is suggested. A selected region of the barrel is filled by water or another liquid, mixture of liquids or slurry. The refrigerating media is supplied into a heat exchanger cooling the selected section of the barrel. The freezing conditions (rate of the heat removal, duration of cooling) assure desired cohesion of the slug and its adhesion to the barrel. When freezing is completed, the axial pressure is exerted on the internal edge of the slug. When the pressure exceeds the adhesion forces, the slug will move toward the open end with acceleration determined by the axial forces. If the exerted pressure force is not sufficient for the slug separation the expansion radial forces are applied to the barrel or the interface between the slug and the barrel is heated. After the separation the compressed media drives the slug toward the open end of the barrel. In the course of the motion the slug accelerates up to the maximal available velocity of the driving fluid. After exiting the barrel the slug impacts a target similarly to a striker or bullet. The impact conditions are determined by the slug velocity, dimensions, shape and structure and are selected to assure a desired material modification (penetration, fracturing, spallation, and plastic deformation). In the course of impact the slug is decomposed, melted and the generated liquid is removed from the impact zone.

10 Claims, 3 Drawing Sheets

SELFRECHARGEABLE GUN AND FIRING PROCEDURE

This application claims the benefit of Provisional application No. 60/233,869 filed Sep. 20, 2000.

FIELD OF THE INVENTION

This invention relates to the methods and devices (guns, fire arms, jackhammer, sand blasters, abrasive waterjets, forming presses, needle-free syringes) utilized for the acceleration of a solid body (bullets, particle, slug, striker, die) to a velocity sufficient for removal, deformation or modification of the target material.

BACKGROUND OF THE INVENTION

Material processing via impact of a fast moving solid slug is a common practice of material processing technology. The application of this technique is illustrated by the operation of such devices as a gun, steam hammer, stamping press, jack hammer, sand blaster, abrasive jet, needle-free medication delivery system, etc. Despite the design and application differences the operation of all devices above is based on a common principle. A solid body (the striker, the bullet, the die, the abrasive particle, etc.) is accelerated by a moving solid or fluid media. The acceleration can be attained by pushing of a solid slug or entrainment of solid particles into a moving stream. A driving fluid can be supplied from an outside source (steam hammer, jackhammer, abrasive waterjet) or generated within the device (a gun). A solid body can be connected to a driver via links (the eccentric press). Despite a wide variety of the design and applications the devices above have common shortcomings.

The solid slug should be replaced for each shot as a gun bullet or should be retracted. The former requires storing the slugs while the latter limits the distance between the exit of the barrel and the target.

Non-retractable slugs (bullets) pollute the area in vicinity of the targets as well as disclose the way and the source of firing.

It is difficult if not impossible to change the propertys of the slug in the course of the gun operations.

In the course of the multiple firing the driving fluid must be removed from the barrel after each shot. This limits the frequency of the firing.

In the existing guns the bullet is not fixed thus the expansion of the driving fluid started immediately as the fluid generated or supplied into the barrel. This limits the maximum slug velocity attained in the course of firing.

It is in object of the present invention to generate the slug (bullet) in a barrel in the course of firing.

It is a further object of the present invention to control the slug characteristics in the course of the slug formation.

It is a further object of the present invention to control precisely the pressure exerted on the slug.

It is a further object of the present invention to eliminate the slug after the impact.

SUMMARY OF THE INVENTION

Generally the present invention comprises a method and device for generation of solid slugs and acceleration of these slugs at the precisely controlled manner up to a high precisely controlled.

In accordance with the method of the present invention the formation and acceleration of the slug is effected by the steps of:

Accumulation of a fluid, a solution, a suspension or a slurry in a precisely controlled section of the barrel.

Cooling the fluid accumulated in a precisely controlled section of the barrel at a precisely controlled rate until the solidification of the precisely controlled amount of fluid is completed.

Exert the axial force on the slug when the solidification of the fluid is completed.

Control the static pressure in the barrel after completion of the slug formation.

Energy injection in the fluid accumulated in the barrel after the slug formation in order to increase the pressure in the barrel.

Increase the pressure in the supply reservoir in order to control pressure in the barrel.

Supply an additional high pressure fluid into the barrel in order to control pressure after the slug formation.

Control the adhesion forces between the walls of the barrel and the slug by heating of the barrel-slug interface and by applying expanding forces to the barrel at the site of the slug formation.

Separation of the slug from the barrel using high pressure fluid, piston or magnetic field.

Acceleration of the separated slug by the exerting the force which caused slug separation, applying a different force or both.

Precise control of the slug velocity by the control of the driving force and the distance between the edge of the barrel and the site of the slug formation.

Collecting of the fluid escaping barrel and return it to the fluid reservoir.

Directing the barrel to a desired site of the target

Selecting the impact conditions so that a desired form of the material processing (removal, deformation, melting, modification) is attained.

Control the frequency of the impacts by the control of duration of slug formation and the selection of a number of barrels used simultaneously and in a sequence.

The device for the use in the effecting the method of the present invention comprises of:

A cylindrical or shaped barrel filled with water or another fluid to be frozen and facilitated with a movable cooling coil or an electrical cooling element A fluid source connected with the barrel via a conduit with a check valve A movable opening in the barrel covered by a moving lock so that fluid in the barrel cannot be accumulated beyond the selected site of the slug formation A coaxial moving heating coils attached to the barrel so that the location and the length of the region of freezing is precisely controlled A coaxial heating and magnetic coils attached to the barrel so that the temperature of the ice-barrel interface and the stresses in this interface can be precisely controlled Electrodes, connected with a system controlling supply of the fluid and the cooling media in the barrel and inserted into the barrel in the site of the slug formation so that the electrical resistance between the electrodes increases as water freezing Pressure sensor installed in the barrel before the site of the slug formation is connected with system controlling supply of the fluid and the cooling media in the barrel The source of a high pressure fluid connected with barrel via a conduit facilitated with a control valve or an attachment for powder explosion A guiding mechanism controlling the position of the gunso that the direction of the axis is precisely controlled.

An array of barrels connected with same sources of a low and high pressure fluids

BRIEF DESCRIPRTION OF THE DRAWINGS

Figure 3:
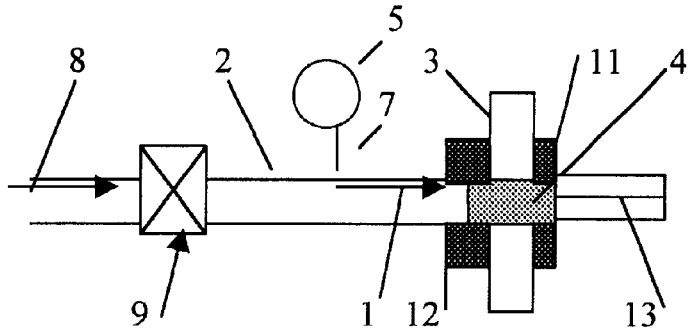

FIG. 3. is a view showing a schematics of the position of slug using barrel geometry.

Figure 4:
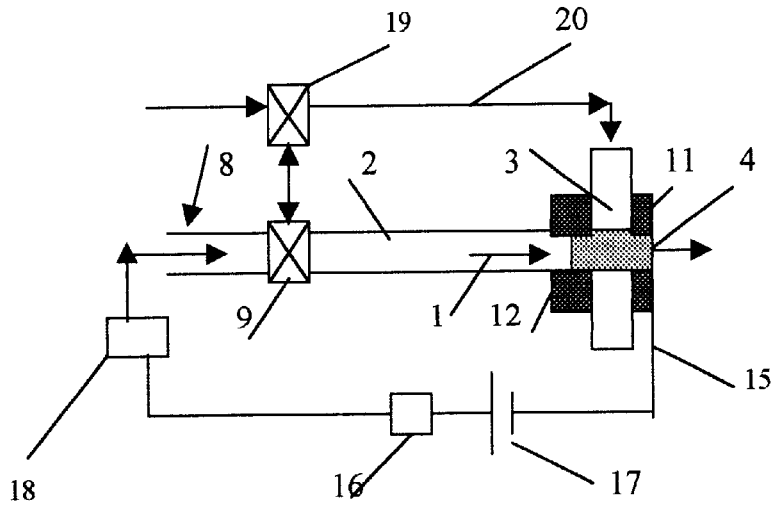

FIG. 4 is a view showing a schematics of the automatically control of the timing of the firing.

Figure 5:
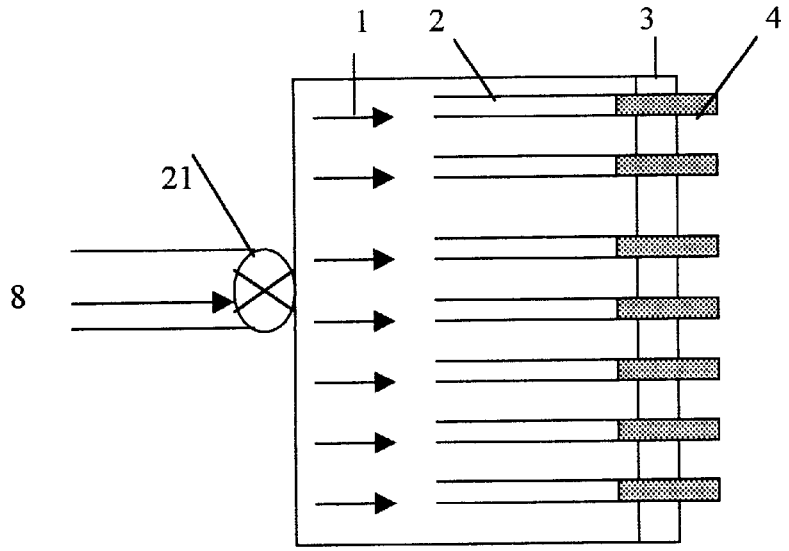

FIG. 5 is a view showing schematics of the multiple gun system.

Figure 6:
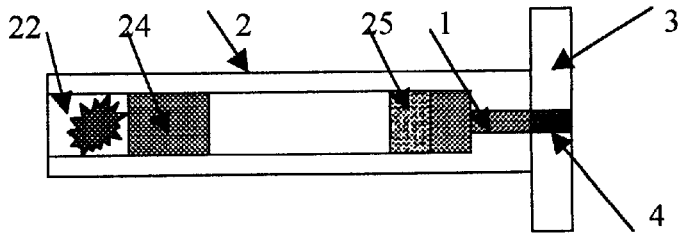

FIG. 6 is a view showing schematics of the slug acceleration using explosion in the barrel.

Figure 7:
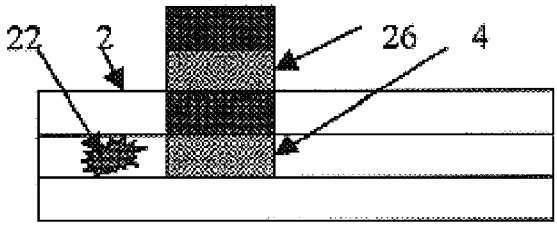

FIG. 7 is a view showing schematics of the slug acceleration using explosion in the barrel with automatical loading of ice slug generated outside of the barrel.

Figure 8:
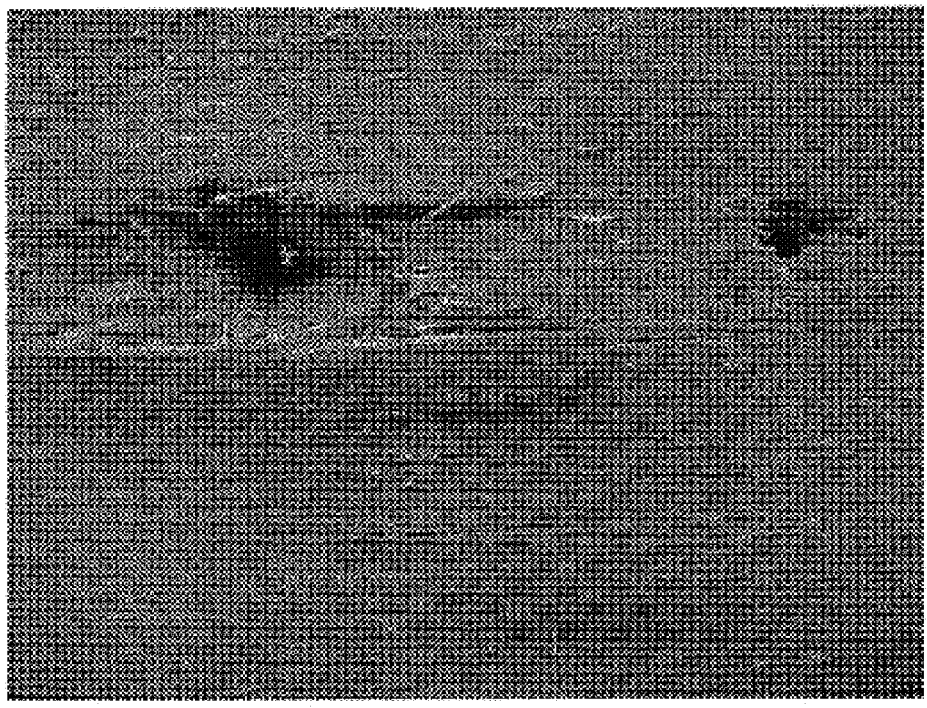

FIG. 8 is a view showing the surface of a plywood thickness 20 mm after the impact of ice bullets.

DESCRIPTION OF PREFERRED EMBODIMENTS

According to the present invention the bullet formation constitutes a cyclic process involving the following steps:

fluid supply into the section of the barrel fluid freezing in a selected section exerting high pressure on the edge of the slug.

positioning the gun

Fluid accumulation in a precisely controlled section of the barrel constitutes the first step of the process. A pure fluid, solution, suspension or slurry is fed into the barrel from a reservoir. In order to control slug properties several liquids will be mixed to form a working fluid. The solid particles will also be added to the mixture. Most probably, however, the slugs will be fabricated out of regular water or aqueous solutions. The fluid fills the selected section of the barrel. This can be achieved by the use of the slots in the barrel. The fluid passing the selected zone flows out of the barrel and returns to the reservoir or is desposed. The slot is open during fluid accumulation and then closed by a movable lid.

The slurry accumulation in the barrel is combined with cooling. The slurry flows via the barrel at a speed, which is determined by the rate of the heat removal at the freezing zone. The speed is selected so that the fluid flow is frozen at a given rate of the heat removal during a desired period of time. Heat from the freezing zone is removed via heat exchange between the fluid and the cooling media (refrigerant, liquid gas, electrical cooler). The duration of the freezing is controlled by the rate of heat removal from the fluid that is by the temperature and flow rate of the cooling agent, refrigerant and/or a liquid gas. The rate of cooling also controls the adhesion between the slug and the barrel. The strength of the adhesion should be minimal. In the course of the fluid accumulation no fluid flows beyond the freezing zone.

In order to assure the precise location of the freezing zone heat is removed from the barrel so that freezing occurs within this zone and is supplied to the barrel so that no freezing occurs outside this zone. The thermal sinks prevent the "flow of the cold" from the cooling media to the fluid before and beyond the freezing zone. Additional control of the freezing that is of the duration of the formation and the properties of the ice can be attained by the inducing fluid vibration using the vibrators attached to the barrel, fluid mixing using magnetic forces, addition of the particles into the fluid which constitutes the nucleation sites, etc.

After the completion of freezing the pressure exerted on the inner edge of the slug increases at a high rate. When freezing is completed the fluid in the barrel decelerates and according to the Bernoulli equations the static pressure increases. This increase results in the separation of the slug from the barrel. If this increase is not sufficient for the slug separation, the pressure in the barrel can be elevated by the use of an amplifier which does not affect fluid flow during the accumulation stage and compresses fluid in the barrel after the completion of freezing. Separation of the slug can be attained via a direct impact by a piston, electrical discharge, powder explosion, a magnetic field, etc.

The pressure in the barrel can also be elevated by the fluid supply from another source. A high-pressure reservoir is connected with the barrel via a conduit with a control valve. The valve opens when the slug is formed and closes when the slug is expelled from the barrel. The pressure in the high-pressure reservoir is developed by a pump or by the direct energy injection. The energy can be injected by impact, electrical discharge, powder explosion, etc. The fluid extruded from this reservoir can be further accelerated by the cumulative (converging) nozzle prior to the injection into the barrel. The fluid velocity at the exit of the nozzle can reach 3–4 km/sec. The pressure needed for the slug separation can be reduced by heating the ice-barrel interface or by the barrel expansion at the site of the slug formation for example by the use of a magnetic field.

After separation from the barrel the high-pressure fluid drives the slug within the barrel. The pressure exerted on the slug results in slug acceleration. The momentum gained by the slug in the course of the acceleration is determined by the equation:

$$M(t)=mv(t)=(PA-Ff)dt$$

Here M=momentum of the slug at the instant t, t=time duration from the initiation of the motion that is from the slug separation from the barrel, m=mass of the slug, v(t)=slug velocity at the instant t, P=pressure on the slug edge, A=area exposed to the pressure P, Ff-friction force generated at the barrel-slug boundary. As it follows from the above equation, in order to increase the momentum of the slug it is necessary to increase the pressure exerted on the slug, duration of the slug motion, that is the length of the barrel and to reduce the friction between the slug and the barrel that is to reduce the area of the slug-barrel interface and the roughness of the barrel. The slug accelerated to a desired velocity exit the barrel and impacts the target. In the course of the impact the slug decomposes and generates ice particles. The impact pressure and the erosion by the generated particles bring about the desired removal of the target material. Thus impact results in desired processing the target surface. Maximal velocity attained by the slug will be equal to that of the driving media (piston, expending gas, fast moving fluid, etc.).

The frequency of the gun firing changes from the a kHz to 0.01 Hz. In order to maintain the desired frequency the timing of processes involved should be precisely controlled. Fluid supply from the low-pressure source starts when the slug is expelled from the barrel and ends when freezing is completed. Fluid supply from the high-pressure source starts when the slug is formed and ends when the slug is expelled from the barrel. The duration of the freezing exceeds by far the duration of the separation and expelling. In order to maintain the desired pressure in the barrel the source of the high pressure fluid and the barrel are separated by valve. The valve is closed when the pressure in the barrel is low (accumulation and the freezing stage). The valve is open when the pressure in the supply barrel is high (separation and the acceleration stages). The duration of the fluid accumulation, freezing and slug separation must be minimal in order to assure the maximal frequency of slug generation, while in order to increase the slug momentum the duration of the acceleration stage should be maximal.

Figure 1:
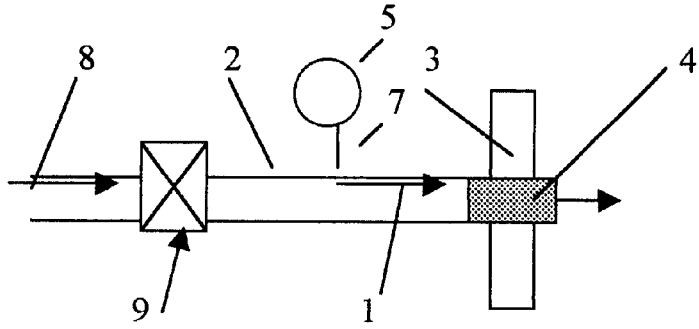
FIG. 1 is a view showing a schematics of the selfchargeable gun.

The various versions of the device effecting the invented method are depicted in FIGS. 1–7. As it is shown in FIG. 1 the fluid 1 flowing through the barrel 2 subject to cooling by the heat sink 3. A heat exchanger or thermal electrical element are used to construct the heat sink which forms the slug 4. The fluid 1 is supplied to the barrel 2 from the reservoir via the conduit 7 facilitated with a check and control valves 5. The high pressure fluid separating and accelerating slug 4 is supplied from the source 8 via the control and check valves 9. The cooling elements can be moved along the barrel in order to facilitate a desired location and a length of the slug. The crossection of the slug is determined by the crossection of the barrel, which can be circular, recctangular, triangular, ellepsoidal, etc.

Figure 2:
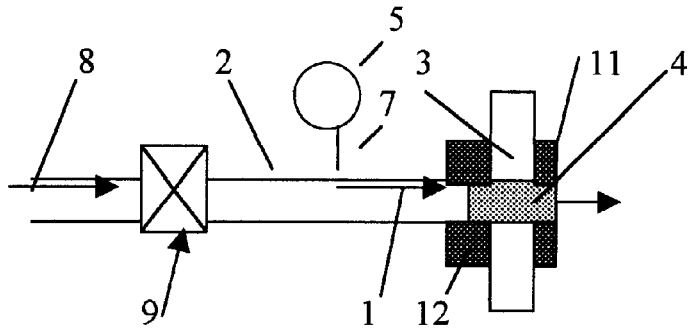
FIG. 2 is a view showing a schematics of the thermal control of the position of slug.

FIG. 2 shows the fluid 1 flowing through the barrel 2 subject to cooling by the heat sink 3. A heat exchanger or thermal electrical element are used to construct the heat sink which forms the slug 4. The fluid 1 is supplied to the barrel 2 from the reservoir via the conduit 7 facilitated with a check and control valves 5. The high pressure fluid separating and accelerating slug 4 is supplied from the source 8 via the control and check valves 9. Heating coils 11 and 12 precisly control the length and position of the slug.

FIG. 3 shows the fluid 1 flowing through the barrel 2 subject to cooling by the heat sink 3. A heat exchanger or thermal electrical element are used to construct the heat sink which forms the slug 4. The fluid 1 is supplied to the barrel 2 from the reservoir via the conduit 7 facilitated with a check and control valves 5. The high pressure fluid separating and accelerating slug 4 is supplied from the source 8 via the control and check valves 9. Heating coils 11 and 12 precisly control the length and position of the slug. The slot 13 prevent fluid flow beyond the position of the slot and extends the length of the barrel without the change of the slug position.

FIG. 4 is a view showing a schematics of the automatically control of the timing of the firing. The electrodes 15 measuring the resistance of the fluid in the section 4 are connected with the control system 16 having power source 17 and connected with the on-off controller 18 of the high pressure pump. The valve/sensor 9 of the high pressure stream is connected with on-off valve 19 installed on the line 20 of supply of the refrigerant. The control system operates as following. At the beginning of the cycle the barrel is filled with the fluid forming the slug and the refrigerant is supplied to the heat exchangers. The thin water layer connects the electrode 15 with the barrel. The electrical circuit is closed and the high pressure source is separated from the barrel. When freezing is completed an ice layer separates the electrode 15 from the barrel. Electrical circuet brakes and the control system 16 via actuator 18 connects the high pressure pump with barrel. The valve/sensor 9 via the valve 19 shut the refrigerant off. The high pressure expells the ice slug. After the slug is expelled the ice layer between the electrode 15 and the barrel 2 melts, the water layer develops and the electrical cilose. The control system separates the high pressure pump from the barrel and open the refrigerant supply line. The cycle repeats.

FIG. 5 shows the use of an array of the barrels when it is necessary to develop a distributed impact. The array of barrels 2 are facilitated with a single heat exchanger 3 and single sources of the low and high pressure fluids. The distributer 21 supplies the high pressure fluid in individual barrels according of a selected program so that slugs can be formed and expelled simultanuously or sequentially.

FIG. 6 shows the slug acceleration using a direct injection of the energy via the explosion into the barrel. The powder charge 22 explodes in the barrel 23 attached to the barrel 2 where the slug is generated. The explosion drives the piston 24 which impacts the ice slug generated in the barrel 2 directly or via an intermediate seal 25 and the fluid 1. The ice slug 4 is expelled from the barrel 2. The energy can be injected directly into the fluid via the electrical discharge, the magnetically field, the mechanical impact, etc.

FIG. 7 shows the slug acceleration using explosion 22 in the barrel 2 with automatically loading of ice slug 4 generated outside of the barrel. The holder of the slugs 26 supplies slugs 4 into the barrel 2. The explosion of the charge 22 expels a slug 4 out of the barrel. After the slug expelling the new is supplied into the barrel from the holder 26.

FIG. 8 shows the holes in a plywood having the thickness of 20 mm generated by the impacting ice bullets. The large hole 27 formed by two subsequent impacts, while the small hole 28 is formed by a single impact.

The following examples illustrate the operation of the invented gun.

EXAMPLE 1

Water is supplied into a pipe from a high-pressure pump. The pipe ID is ¼", the length of the tube is 2–6" and the pump pressure ranges from 10,000 psi to 60,000 psi. The pipe is separated from the pump by a check and control valves. A section of a pipe is cooled by liquid nitrogen or by the refrigerant. The length of the cooled section is ⅙–½" and its distance from the pipe edge ranges from 5" to 30". An electrode is located at the distance of 0–0.02" from the pipe at the end of the cooling zone. A water droplet connects the electrode with the pipe surface. The electrode is a part of an electrical circle, which start up and shut down the pump.

The system operates as following. Initially the pipe is filled with water, the pump is shut down, the valve is closed and the cooling media is supplied to the pipe. The water at the cooled region freezes and the ice slug is formed. The water droplet between the electrode and the pipe is frozen and the pump starts up. The timer controls the time log between the slug formation and the initiation of the pump operation. As the pump starts to operate the pressure in the conduit before the slug increases, the valve opens and the high pressure is exerted on the slug. The slug is separated from the pipe (barrel), expelled from the pipe at a high velocity and impacts the target.

After firing the water pressure in the pipe drops and the pumps is shut down. Simultaneously, the ice connecting the electrode and the pipe is melted and the water droplet forms. Then the refrigerant freezes the water at the refrigerated region of the pipe, the water droplet between the electrode and pipe freezes, the pumps starts up, etc.

The process is extremely parameter sensitive. For example, the time log between the completion of slug formation and increase the pressure in the barrel determines the adhesion between the slug and the pipe. The duration of the overcooling determines the adhesion force between the barrel and the slug. If the adhesion is weak, the separation occurs at a low pressure. This pressure will be maintained in the pipe in the course of the slug acceleration and the exit velocity will be limited. If, on another hand, the supercooling is significant, the adhesion forces are excessively high, the available pressure exerted by the pump is not sufficient for the slug separation and the process will be interrupted. In order to restart the system it is necessary to close the flow of the cooling fluid. Then the temperature at the pipe-slug boundary increases, the adhesion forces drops and the slug is expelled from the pipe.

EXAMPLE 2

The pipe with cooled section is connected with a barrel containing powder charge. Both pipes are coaxial. The water in a selected section of the first pipe is cooled and the ice plug is generated. The powder explodes and the developed gases separate and expel the ice slug. The accelerated slug impacts the target.

EXAMPLE 3

Several barrels are connected in parallel. Water is supplied and subsequently freezes simultaneously in each barrel. Then the pressure is increased and the source of the high is connected with one barrel and the slug is expelled from this barrel. The source of the high pressure is sequentially connected with individual barrels and the slug formed in this barrel is accelerated. The order and the frequency of the connecting of barrels to the source of the high pressure is predetermined.

EXAMPLE 4

The fluid consists of the medicine to be injected into the tissue of a patient. The ice slug containing the exact amount of the medicine to be injected is expelled from the gun so it penetrates into the patent body at a precisely controlled site and the medicine is delivered to a patient.

EXAMPLE 5

The invented device is used as a traceless gun, firing lethal or nonlethal bullets. After impacting the surface of the substrate the ice bullet is melted and no traces of the bullet remains.

The gun will be used as a machining tool for cleaning, decoating, drilling, cutting, material modification, as a lethal and a nonlethal weapon, as a contactless needle, etc.

What is claimed is:

1. An apparatus for forming a slug from fluid and for discharging the slug toward a target, comprising:

a barrel having a first end, a second end and an inner surface a fluid delivery device, connected to said barrel, operable to deliver the fluid to a slug formation area of said barrel;

a temperature control device operable to cool said slug formation area until a slug is formed from said fluid such that said slug is retained against said inner surface of said barrel by a predefined adhesion force therebetween;

firing device operable to deliver pressure to a chamber portion of said barrel, said chamber portion being defined between said first end of said barrel and said formed slug, said pressure within said chamber portion having sufficient magnitude to exceed said predefined adhesion force and to expel the slug through said second end of said barrel at a predetermined velocity toward the target; and a linear translation device operable to move said temperature control device along said barrel to change the position of said slug formation area in said barrel.

2. The apparatus of claim 1, wherein the fluid comprises one of: water, water-based slurry, and water having a plurality if particles suspended therein.

3. The apparatus of claim 1, further comprising:

a first fire control device operable to automatically expel said slug at said predetermined velocity, comprising a sensing device that determines when said predefined adhesion force between the slug and said inner surface of said barrel is reached; and signal device connected to said firing device operable to issue a firing signal to activate said firing device when said sensing device determines that said predefined adhesion force is reached.

4. The apparatus of claim 3, wherein said sensing device comprises:

a current source;

a pair of electrodes connected to said current source and positioned at said barrel such that the slug is formed therebetween; and resistance sensor operable to:

measure electrical resistance between said electrodes, wherein a predetermined resistance value corresponds to said predefined adhesion force, and when said electrical resistance reaches said predetermined resistance value, activate said signal device.

5. The apparatus of claim 1, further comprising:

a second fire control device operable to selectively determine said predetermined velocity by selecting a target predefined adhesion force for said temperature control device.

6. The apparatus of claim 1, wherein said barrel comprises a cross section selected from a group of symmetric and non-symmetric geometric shapes.

7. The apparatus of claim 1, wherein said firing device delivers said pressure through one of: electromagnetic field, gas pressure, fluid pressure, explosive force, and sudden mechanical impact.

8. The apparatus of claim 5, wherein said second fire control device is further operable to control frequency of slug discharge by controlling speed of slug formation by said temperature control device.

9. The apparatus of claim 1, wherein said temperature control device is further operable to control position and shape of the slug by selectively heating at least a portion of said slug formation area.

10. The apparatus of claim 1, further comprising a slot defined in said barrel outside of said slug formation area to prevent flow of the fluid in said barrel beyond said slot and to limit formation of the slug to said slug formation area.

* * * * *